US011433982B2

(12) United States Patent
Yamaguchi et al.

(10) Patent No.: US 11,433,982 B2
(45) Date of Patent: Sep. 6, 2022

(54) ELECTRIC OUTBOARD MOTOR

(71) Applicant: YAMAHA HATSUDOKI KABUSHIKI KAISHA, Iwata (JP)

(72) Inventors: Yuki Yamaguchi, Shizuoka (JP); Yoshimasa Kan, Shizuoka (JP)

(73) Assignee: YAMAHA HATSUDOKI KABUSHIKI KAISHA, Shizuoka (JP)

( * ) Notice: Subject to any disclaimer, the term of this patent is extended or adjusted under 35 U.S.C. 154(b) by 16 days.

(21) Appl. No.: 17/151,838

(22) Filed: Jan. 19, 2021

(65) Prior Publication Data

US 2021/0245853 A1 Aug. 12, 2021

(30) Foreign Application Priority Data

Feb. 12, 2020 (JP) ..... JP2020-021772

(51) Int. Cl.

| | |
|---|---|
| ***B63H 20/12*** | (2006.01) |
| ***B63H 1/14*** | (2006.01) |
| ***B63H 20/14*** | (2006.01) |
| ***B63H 21/17*** | (2006.01) |
| ***B63H 21/21*** | (2006.01) |

(52) U.S. Cl.

CPC ..... *B63H 20/12* (2013.01); *B63H 1/14* (2013.01); *B63H 20/14* (2013.01); *B63H 21/17* (2013.01); *B63H 21/213* (2013.01); *B63H 2021/216* (2013.01)

(58) Field of Classification Search

CPC ..... B63H 20/12; B63H 1/14; B63H 21/17; B63H 21/213; B63H 2021/216

See application file for complete search history.

(56) References Cited

U.S. PATENT DOCUMENTS

| | | | | |
|---|---|---|---|---|
| 4,624,206 | A | 11/1986 | Frye et al. | |
| 6,638,122 | B1 * | 10/2003 | Griffith, Sr. | H02P 25/0925 440/6 |
| 8,043,132 | B1 * | 10/2011 | Wyant | B60L 53/14 440/1 |
| 2006/0003644 | A1 * | 1/2006 | Okabe | B63H 20/12 440/63 |
| 2009/0264032 | A1 | 10/2009 | Kubota et al. | |

(Continued)

FOREIGN PATENT DOCUMENTS

| | | | | |
|---|---|---|---|---|
| EP | 2891605 | A1 * | 7/2015 | B63H 20/007 |
| JP | 2513999 | Y2 | 10/1996 | |

OTHER PUBLICATIONS

Official Communication issued in corresponding European Patent Application No. 21153013.4, dated Jun. 21, 2021.

*Primary Examiner* — Stephen P Avila

(74) *Attorney, Agent, or Firm* — Keating and Bennett, LLP

(57) ABSTRACT

An electric outboard motor includes an outboard motor main body that includes an electric motor and a tiller handle that turns together with the outboard motor main body with respect to a hull. The tiller handle includes a handle bar that turns together with the outboard motor main body with respect to the hull, an accelerator grip that is rotatable with respect to the handle bar and that is rotated when the electric motor is rotated, and a shift switch located closer to a distal end of the accelerator grip with respect to a proximal end of the accelerator grip and that is operated when a shift state of the outboard motor main body is switched between a forward mode and a reverse mode.

10 Claims, 9 Drawing Sheets

(56) References Cited

U.S. PATENT DOCUMENTS

| | | | | |
|---|---|---|---|---|
| 2013/0045648 | A1 | 2/2013 | Kinpara et al. | |
| 2015/0232162 | A1 | 8/2015 | Kinpara et al. | |
| 2020/0309015 | A1* | 10/2020 | Watanabe ..... | F01P 3/205 |

* cited by examiner

ELECTRIC OUTBOARD MOTOR

CROSS REFERENCE TO RELATED APPLICATIONS

This application claims the benefit of priority to Japanese Patent Application No. 2020-021772 filed on Feb. 12, 2020. The entire contents of this application are hereby incorporated herein by reference.

BACKGROUND OF THE INVENTION

1. Field of the Invention

The present invention relates to an electric outboard motor including an electric motor that rotates a propeller.

2. Description of the Related Art

US 2013/0045648 A1 discloses an electric outboard motor. When a user operates a steering handle that is equivalent to a tiller handle, an outboard motor main body including an electric motor turns rightwardly and leftwardly. When the user rotates a throttle grip disposed on the steering handle, the rotation of the electric motor is transmitted to a propeller so that the propeller rotates. When the user rotates the throttle grip after the user operates a shift switch disposed on the steering handle, the rotation direction of the electric motor is switched.

In the electric outboard motor described in US 2013/0045648 A1, the shift switch that performs switching between rotation directions of the electric motor is disposed closer to the outboard motor main body than the throttle grip. Therefore, the user cannot operate the shift switch with the same hand while holding the throttle grip. If the user operates the shift switch with the remaining hand other than the user's hand with which the user holds the throttle grip, the user is required to twist his/her body, and cannot easily operate the shift switch.

SUMMARY OF THE INVENTION

Preferred embodiments of the present invention provide electric outboard motors each including an outboard motor main body that includes an electric motor to rotate a propeller and a tiller handle that turns with respect to a hull together with the outboard motor main body. The tiller handle includes a handle bar that turns together with the outboard motor main body with respect to the hull, an accelerator grip that includes a proximal end located closest to the outboard motor main body and a distal end located at a position opposite to the outboard motor main body with respect to the proximal end, that is rotatable with respect to the handle bar, and that is rotated when the electric motor is rotated in a forward rotation direction or in a reverse rotation direction, and a shift switch located closer to the distal end of the accelerator grip with respect to the proximal end of the accelerator grip and that is operated when a shift state of the outboard motor main body is switched between a forward mode in which the electric motor rotates in the forward rotation direction in response to rotation of the accelerator grip and a reverse mode in which the electric motor rotates in the reverse rotation direction in response to rotation of the accelerator grip.

According to this structural arrangement, the accelerator grip and the shift switch are located on the tiller handle. When the user operates the shift switch, the outboard motor main body is switched to the forward mode or to the reverse mode. If the user rotates the accelerator grip when the outboard motor main body is in the forward mode, the electric motor rotates in the forward rotation direction, and the propeller generates a thrust by which the vessel is forwardly moved. If the user rotates the accelerator grip when the outboard motor main body is in the reverse mode, the electric motor rotates in the reverse rotation direction, and the propeller generates a thrust by which the vessel moves backwardly.

The shift switch is located closer to the distal end of the accelerator grip with respect to the proximal end of the accelerator grip. In other words, the shift switch is located on the accelerator grip or near the accelerator grip, and the distance from the user's hand with which the accelerator grip is grasped to the shift switch is short. Therefore, the user is able to operate the shift switch with the user's hand with which the accelerator grip is grasped. Alternatively, the user is able to operate the shift switch with the user's remaining hand other than the hand with which the accelerator grip is grasped without largely twisting the user's body. Therefore, the user is able to easily operate the shift switch.

According to preferred embodiments of the present invention, at least one of the following features may be added to the electric outboard motor.

An electric outboard motor according to a preferred embodiment of the present invention further includes a shift limiter that enables the shift state of the outboard motor main body to be switched in response to an operation of the shift switch when the accelerator grip is located in an initial position in which the electric motor does not rotate.

According to this structural arrangement, the shift state of the outboard motor main body is able to be switched in response to the operation of the shift switch when the accelerator grip is located in the initial position. The initial position is a position in which the rotor of the electric motor stands still without rotating. Therefore, the shift state of the outboard motor main body is prevented from being switched even if the user unintentionally touches the shift switch when the electric motor rotates or even if the shift switch hits against something other than the user when the electric motor rotates.

An electric outboard motor according to a preferred embodiment of the present invention further includes an accelerator position sensor to detect a rotation angle of the accelerator grip with respect to the handle bar, and the shift limiter includes an electronic control unit to determine whether the accelerator grip is located in the initial position based on a detection value of the accelerator position sensor and that enables the shift state of the outboard motor main body to be switched in response to an operation of the shift switch when the accelerator grip is located in the initial position.

According to this structural arrangement, the rotation angle of the accelerator grip with respect to the handle bar is detected by the accelerator position sensor. Based on a detection value of the accelerator position sensor, the electronic control unit determines whether the accelerator grip is located in the initial position, and, when the accelerator grip is located in the initial position, the shift state of the outboard motor main body is able to be switched in response to the operation of the shift switch. Therefore, it is possible to prevent the switching of the shift state of the outboard motor main body even if a mechanical restriction, such as the shift stopper, is not provided.

The shift switch includes a switch button movable between an ON position in which the shift state of the outboard motor main body is switched to the forward mode or to the reverse mode and an OFF position in which the shift state of the outboard motor main body is maintained, and the shift limiter includes a shift stopper that enables the switch button to move to the ON position when the accelerator grip is located in the initial position. In this case, the electric outboard motor may further include an accelerator stopper that prevents rotation of the accelerator grip with respect to the handle bar when the switch button is in the ON position.

According to this structural arrangement, the switch button of the shift switch is moved by the user between the ON position and the OFF position. The shift state of the outboard motor main body is maintained when the switch button is in the OFF position. When the user moves the switch button to the ON position, the shift state of the outboard motor main body is switched to the forward mode or to the reverse mode.

If the user attempts to move the switch button to the ON position in a shift state in which the accelerator grip is located in the initial position, the switch button moves to the ON position without hitting against the shift stopper. If the user attempts to move the switch button to the ON position in a shift state in which the accelerator grip is located in a position other than the initial position, the switch button hits against the shift stopper, and stops before arriving at the ON position. Therefore, even if an electric restriction is not provided, it is possible to enable the shift state of the outboard motor main body to be switched in response to the operation of the shift switch when the accelerator grip is located in the initial position.

If the electric outboard motor further includes the accelerator stopper, it is impossible to rotate the accelerator grip with respect to the handle bar when the switch button is in the ON position. Therefore, the rotation of the accelerator grip is prevented by the accelerator stopper even if a force by which the accelerator grip is rotated is unintentionally applied to the accelerator grip when the user moves the switch button to the ON position. This makes it possible to prevent the electric motor from starting rotating during the operation of the switch button.

The shift switch includes a switch button movable between an ON position in which the shift state of the outboard motor main body is switched to the forward mode or to the reverse mode and an OFF position in which the shift state of the outboard motor main body is maintained, and the electric outboard motor further includes an accelerator stopper to prevent rotation of the accelerator grip with respect to the handle bar when the switch button is located in the ON position. In this case, the accelerator stopper may enable the accelerator grip to rotate with respect to the handle bar when the switch button is located in the OFF position.

According to this structural arrangement, the switch button of the shift switch is moved by the user between the ON position and the OFF position. It is impossible to rotate the accelerator grip with respect to the handle bar when the switch button is in the ON position. Therefore, the rotation of the accelerator grip is prevented by the accelerator stopper even if a force by which the accelerator grip is rotated is unintentionally applied onto the accelerator grip when the user moves the switch button to the ON position. This makes it possible to prevent the rotation angle of the accelerator grip from changing during the operation of the switch button.

If the accelerator stopper enables the accelerator grip to rotate with respect to the handle bar when the switch button is located in the OFF position, the accelerator grip hits against the accelerator stopper, and the rotation is prevented when the user attempts to rotate the accelerator grip in a shift state in which the switch button is in the ON position. On the other hand, when the user attempts to rotate the accelerator grip in a shift state in which the switch button is in the OFF position, the accelerator grip rotates with respect to the handle bar without hitting against the accelerator stopper. Therefore, it is possible to rotate the electric motor when the shift state of the outboard motor main body is maintained.

The accelerator grip is rotatable with respect to the shift switch, and the shift switch does not rotate with respect to the handle bar even if the accelerator grip rotates with respect to the handle bar.

According to this structural arrangement, the accelerator grip rotates not only with respect to the handle bar but also with respect to the shift switch. Even if the user rotates the accelerator grip with respect to the handle bar, the shift switch does not rotate with respect to the handle bar. If the shift switch rotates with respect to the handle bar, electrical components, such as a collector ring and a rotary connector, that transmit electricity between a rotational component and a non-rotational component are required. If the shift switch does not rotate with respect to the handle bar, such electrical components are not required. Therefore, it is possible to simplify the structure of the electric outboard motor.

The electric outboard motor further includes an alarm to communicate information about the outboard motor main body being in the reverse mode by use of one or more of sounds, rays of light, words, drawings, and vibrations. The alarm may be any one among a buzzer that emits sounds, a lamp that emits rays of light, a display that displays words and drawings, and a vibrator that emits vibrations, or may be two or more among these alarms. If a notice (forward notice) differing from a reverse notice that communicates the information that the outboard motor main body is in the reverse mode is used, the alarm may communicate the information that the outboard motor main body is in the forward mode.

According to this structural arrangement, when the outboard motor main body is switched to the reverse mode, this information is communicated by one or more of sounds, rays of light, words, drawings, and vibrations. Therefore, based on a notice issued by the alarm, such as sounds, the user of the electric outboard motor is able to reliably understand that the outboard motor main body is in the reverse mode.

The electric outboard motor further includes a transmission path to transmit rotation of the electric motor from the electric motor to the propeller when the electric motor rotates either in the forward rotation direction or in the reverse rotation direction.

According to this structural arrangement, the transmission path from the electric motor to the propeller is provided. When the electric motor rotates in the reverse rotation direction, the rotation of the electric motor is transmitted to the propeller through the same path (transmission path) as when the electric motor rotates in the forward rotation direction. In an outboard motor including an engine, a dog clutch is moved and a path to transmit rotation is switched in order to reversely rotate a propeller. Therefore, if the mode of the outboard motor main body is switched by operating the shift switch, it is possible to reversely rotate the propeller without switching the transmission path that transmits the rotation of the electric motor.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

As described below, an outboard motor main body 2 is turnable rightwardly and leftwardly with respect to a hull H1, and is turnable upwardly and downwardly with respect to the hull H1. The outboard motor main body 2 in a reference posture is described in the following description unless an explanatory note is provided. The reference posture is a posture in which a rotational center RC1 of a propeller 13 horizontally extends in a front-rear direction. Each of the front-rear, up-down, and left-right directions is defined on the basis of the outboard motor main body 2 in the reference posture.

Figure 1:
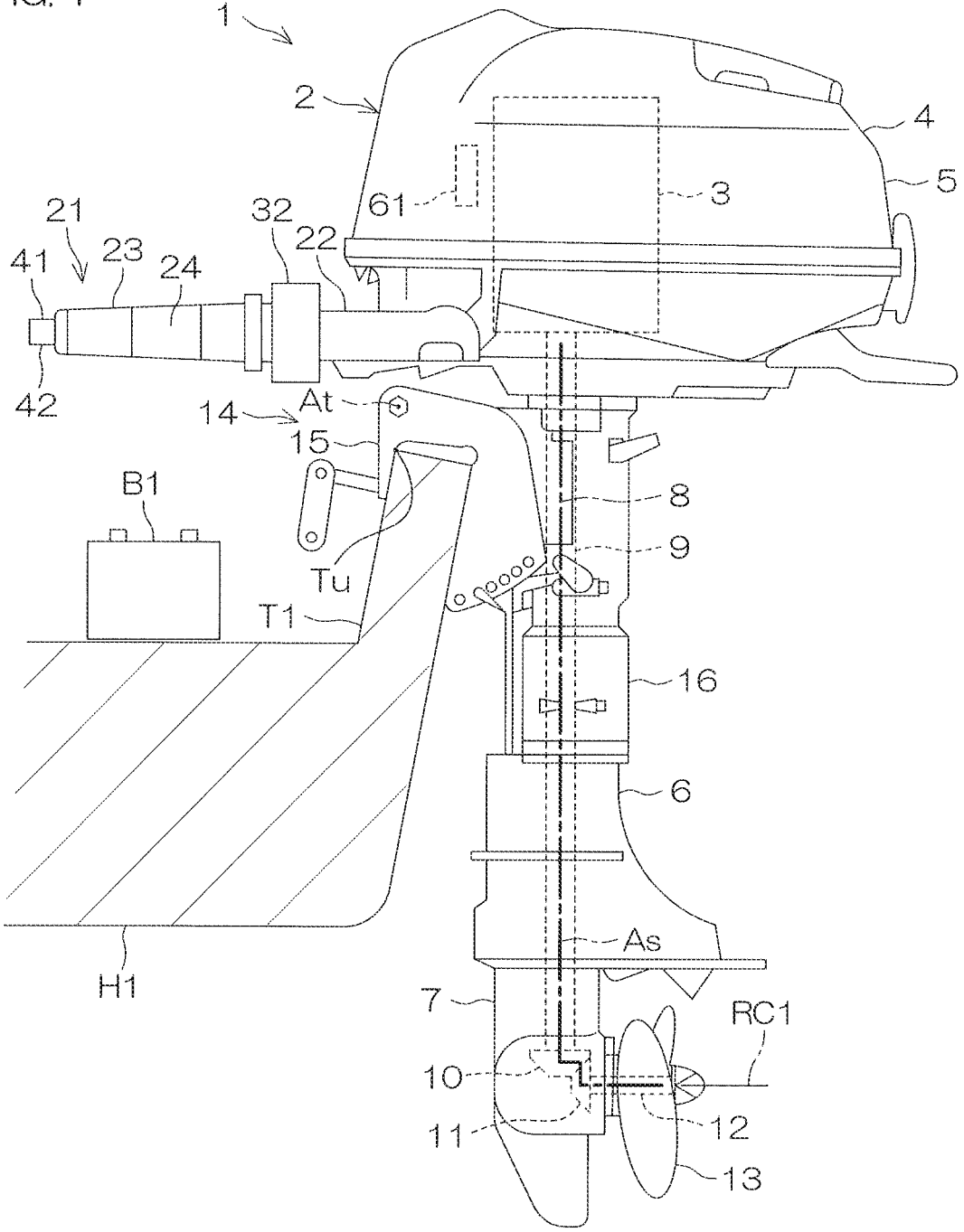
FIG. 1 is a schematic view of a vessel showing a left side surface of an electric outboard motor according to a preferred embodiment of the present invention.

FIG. 1 is a schematic view of a vessel showing a left side surface of an electric outboard motor 1 according to a preferred embodiment of the present invention.

As shown in FIG. 1, the vessel includes a body that floats on the water and an electric outboard motor 1 that generates a thrust by which the body is propelled. The body includes a hull H1 that floats on the water and a deck located above the hull H1. The electric outboard motor 1 includes an outboard motor main body 2 located behind the hull H1, a suspension 14 that attaches the outboard motor main body 2 to the hull H1, and a tiller handle 21 that is rightwardly and leftwardly moved by a user in order to turn the outboard motor main body 2 rightwardly and leftwardly with respect to the hull H1.

The outboard motor main body 2 includes an electric motor 3 that rotates a propeller 13 and a casing 4 that houses the electric motor 3. A portion of the outboard motor main body 2 is located in the water, and the remaining portion of the outboard motor main body 2 is located above the water surface. The electric motor 3 may be located below the water surface, or may be located above the water surface. In the former case, the electric motor 3 may be located in front of the propeller 13, and may be built into the propeller 13. FIG. 1 shows an example in which the electric motor 3 is located above the water surface.

In the example shown in FIG. 1, the casing 4 of the outboard motor main body 2 includes a lower case 7 located in the water, an upper case 6 located above the lower case 7, and a cowl 5 located above the upper case 6. The cowl 5 is located above the water surface. The electric motor 3 is located in the cowl 5. The electric motor 3 and the cowl 5 are located above an upper end Tu of a transom T1 located at a rear portion of the hull H1.

The electric motor 3 is driven by electric power supplied from a battery B1. The electric motor 3 includes a rotor including a permanent magnet, a stator including a coil to which the electric power of the battery B1 is supplied, and a motor housing that houses the rotor and the stator. The battery B1 may be located in the hull H1, or may be located outside the hull H1. In the latter case, the battery B1 may be located in the outboard motor main body 2. FIG. 1 shows an example in which the battery B1 is located in the hull H1.

The rotation of the electric motor 3 is transmitted to the propeller 13 through a transmission path 8 that extends from the electric motor 3 to the propeller 13. In the example shown in FIG. 1, the transmission path 8 includes a drive shaft 9 that extends downwardly from the electric motor 3, a driving gear 10 attached to a lower end portion of the drive shaft 9, a driven gear 11 that engages the driving gear 10, and a propeller shaft 12 that extends rearwardly from the driven gear 11. The driving gear 10 and the driven gear 11 are each a bevel gear. The propeller 13 is attached to a rear end portion of the propeller shaft 12 that protrudes rearwardly from the lower case 7. The propeller 13 rotates at the same speed and in the same direction as the propeller shaft 12.

The suspension 14 includes a pair of clamp brackets 15 fixed to the transom T1 located at the rear portion of the hull H1 and a swivel bracket 16 supported by the pair of clamp brackets 15. The outboard motor main body 2 is attached to the swivel bracket 16. The outboard motor main body 2 is turnable upwardly and downwardly with respect to the pair of clamp brackets 15 around a tilt axis At that extends in the left-right direction, and is turnable rightwardly and leftwardly with respect to the pair of clamp brackets 15 around a steering axis As that extends in the up-down direction.

The tiller handle 21 extends forwardly from the outboard motor main body 2. FIG. 1 shows an example in which the tiller handle 21 extends forwardly from the left side surface of the cowl 5. The tiller handle 21 includes an accelerator grip 23 to be grasped by a user's hand. The accelerator grip 23 is located at a more forward position than the outboard motor main body 2. The accelerator grip 23 is located at a higher position than the upper end Tu of the transom T1. The accelerator grip 23 is located in the hull H1.

When the user rotates the accelerator grip 23, the electric motor 3 rotates, and the rotation of the electric motor 3 is transmitted to the propeller 13. Thus, the propeller 13 rotates with respect to the hull H1. When the user pushes or pulls the accelerator grip 23 rightwardly and leftwardly, a force applied to the accelerator grip 23 from the user is transmitted from the tiller handle 21 to the outboard motor main body 2, and the tiller handle 21 turns together with the outboard motor main body 2 rightwardly and leftwardly around the steering axis As with respect to the hull H1. Thus, the propeller 13 turns rightwardly and leftwardly around the steering axis As with respect to the hull H1.

Figure 2:
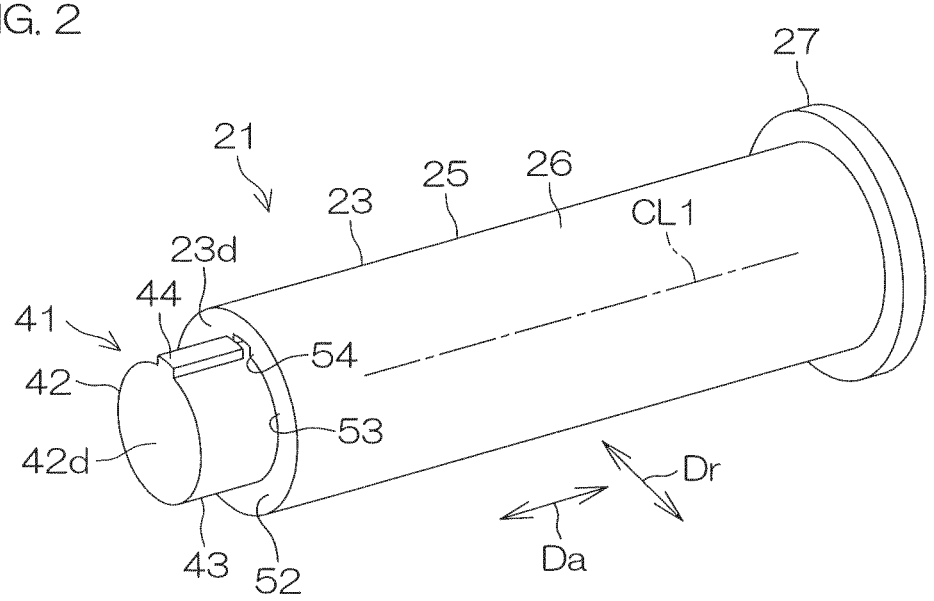
FIG. 2 is a perspective view of a portion of a tiller handle.
Figure 3:
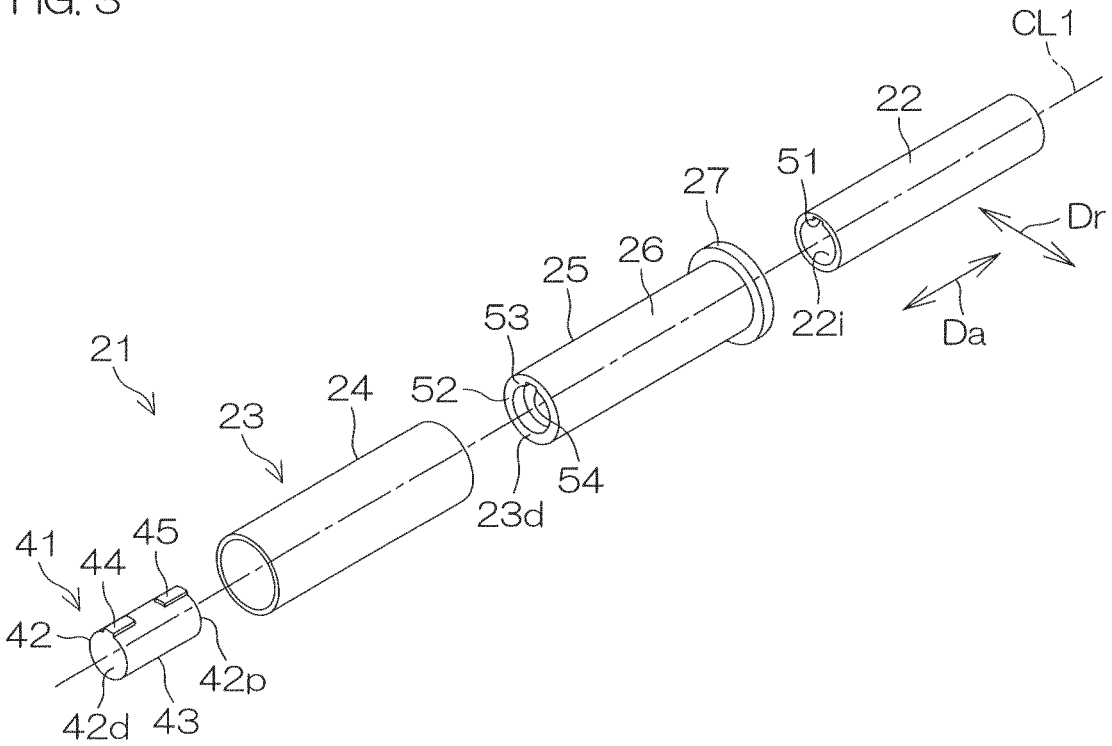
FIG. 3 is an exploded perspective view of the portion of the tiller handle.

FIG. 2 is a perspective view of a portion of the tiller handle 21. FIG. 3 is an exploded perspective view of the portion of the tiller handle 21. In FIG. 2, a sleeve cover 24 described below is omitted.

As shown in FIG. 3, the tiller handle 21 includes a handle bar 22 and a shift switch 41, in addition to the accelerator grip 23. The handle bar 22 has a cylindrical shape extending in the front-rear direction. The accelerator grip 23 and the shift switch 41 are attached to the handle bar 22. The handle bar 22 is attached to the outboard motor main body 2. When the user pushes or pulls the accelerator grip 23 rightwardly and leftwardly, the outboard motor main body 2 turns rightwardly and leftwardly around the steering axis As with respect to the hull H1 at the same angle and in the same direction as the handle bar 22.

The accelerator grip 23 refers to a rotatable member with respect to the handle bar 22 around a center line CL1 of the handle bar 22. The accelerator grip 23 may be a single integral member, or may be a plurality of members connected together. FIG. 3 shows an example of the latter case. In this example, the accelerator grip 23 includes a cylindrical sleeve 25 that surrounds the handle bar 22 and a cylindrical sleeve cover 24 that surrounds the sleeve 25. The sleeve cover 24 is, for example, a rubber member or a resin member that comes into contact with the user's hand. The sleeve cover 24 is fixed to the sleeve 25. The sleeve cover 24 rotates together with the sleeve 25 with respect to the handle bar 22.

As shown in FIG. 3, the sleeve 25 includes a cylindrical tube 26 that extends in an axial direction Da of the handle bar 22 and an annular flange 27 that protrudes from an outer peripheral surface of the tube 26 outwardly in a radial direction Dr of the handle bar 22. The flange 27 is located at an end of the sleeve 25 closer to the outboard motor main body 2 (in FIG. 3, right-hand end). The sleeve cover 24 is opposite to the outboard motor main body 2 with respect to the flange 27. The tube 26 is surrounded by the sleeve cover 24. The outer peripheral surface of the tube 26 is in contact with an inner peripheral surface of the sleeve cover 24.

A proximal end of the accelerator grip 23 refers to a portion, which is closest to the outboard motor main body 2, of the accelerator grip 23. A distal end of the accelerator grip 23 refers to a portion, which is farthest from the outboard motor main body 2, of the accelerator grip 23. A convex portion 28 (see FIG. 4) of an inner ring 30 described below is an example of the proximal end of the accelerator grip 23. An end surface, which is opposite to the outboard motor main body 2, of two end surfaces of the sleeve 25 (in FIG. 2 and FIG. 3, left-hand end surface) is an example of the distal end of the accelerator grip 23. Hereinafter, the end surface is referred to as a distal end surface 23*d* of the accelerator grip 23.

As shown in FIG. 2, the shift switch 41 protrudes in the axial direction Da of the handle bar 22 from the distal end surface 23*d* of the accelerator grip 23. Therefore, the shift switch 41 is located closer to the distal end of the accelerator grip 23 with respect to the proximal end of the accelerator grip 23. The shift switch 41 is operated by the user in order to switch a mode of the outboard motor main body 2 between a forward mode and a reverse mode. The shift switch 41 is operated by, for example, a thumb of the user's hand with which the accelerator grip 23 is grasped. Therefore, the shift switch 41 is located within a range in which the hand of the user grasping the accelerator grip 23 is reachable.

When the user rotates the accelerator grip 23 in a state in which the outboard motor main body 2 is in a forward mode, the electric motor 3 rotates in a forward rotation direction. When the user rotates the accelerator grip 23 in a state in which outboard motor main body 2 is in a reverse mode, the electric motor 3 rotates in a reverse rotation direction. The reverse rotation direction is a rotation direction opposite to the forward rotation direction. Therefore, when the outboard motor main body 2 is in the reverse mode, the propeller 13 rotates in a direction opposite to a direction when the outboard motor main body 2 is in the forward mode even if the user rotates the accelerator grip 23 in the same direction as when the outboard motor main body 2 is in the forward mode.

Figure 4:
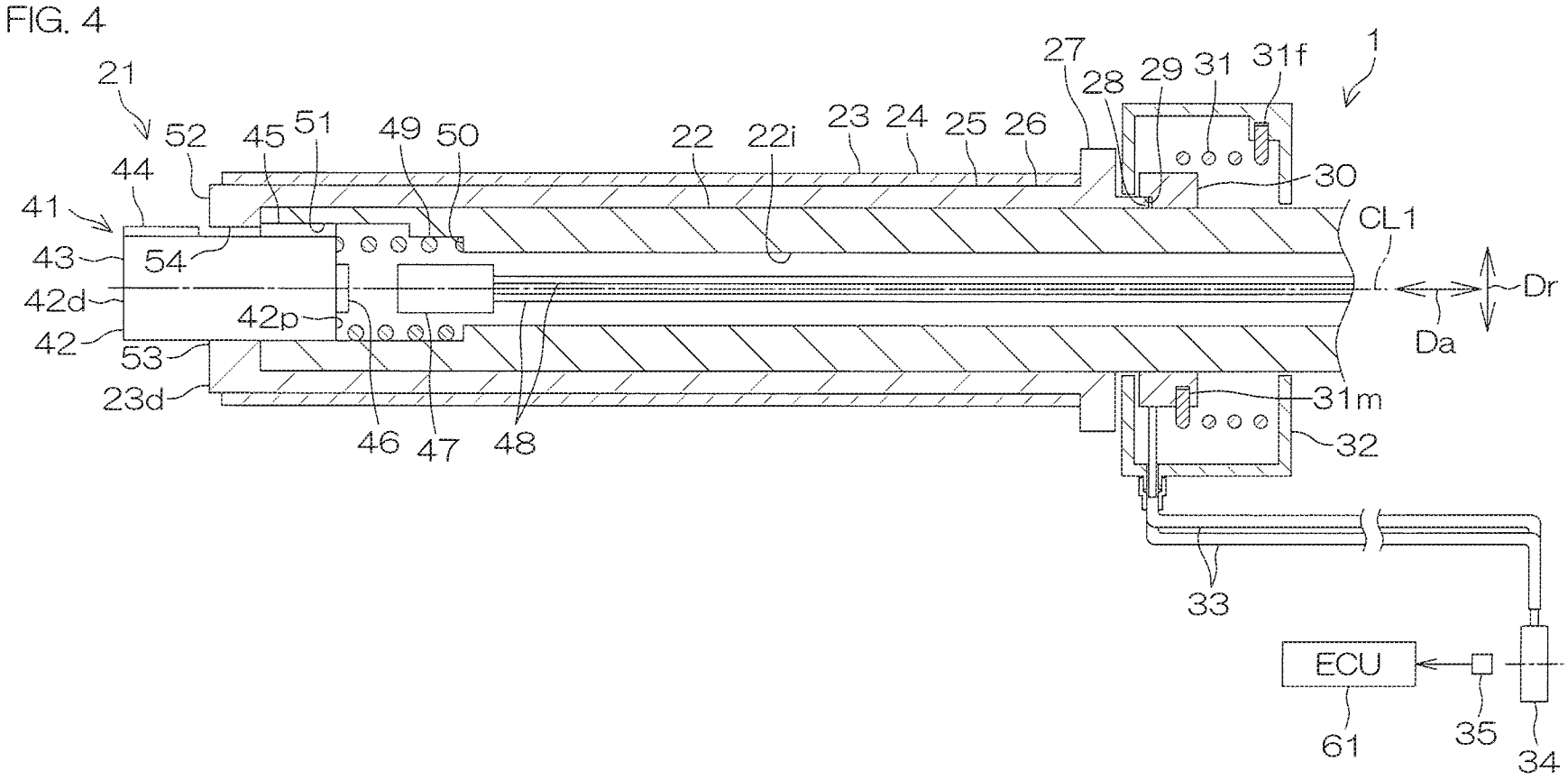
FIG. 4 is a cross-sectional view showing a cross section of the tiller handle along a flat surface including a center line of a handle bar.

FIG. 4 is a cross-sectional view showing a cross section of the tiller handle 21 along a flat surface including the center line CL1 of the handle bar 22.

First, a return spring 31 and an accelerator position sensor 35 will be described. Thereafter, the shift switch 41 will be described.

The accelerator grip 23 is rotatable around the center line CL1 of the handle bar 22 with respect to the handle bar 22 at a rotation angle of less than 360 degrees based on an initial position. FIG. 4 shows a state in which the accelerator grip 23 is located in the initial position. The initial position is a position in which the rotor of the electric motor 3 stands still without rotating. The initial position may be a position in which the rotation angle of the accelerator grip 23 is 0 (zero), or may be a rotation-angle range in which the rotor of the electric motor 3 does not rotate (for example, in which the rotation angle of the accelerator grip 23 is from about 0 to about 0.5 degrees).

The tiller handle 21 includes the return spring 31 that holds the accelerator grip 23 in the initial position. When the user rotates the accelerator grip 23 in the initial position, the return spring 31 is elastically deformed, and a restoring force that returns the accelerator grip 23 to the initial position is generated in the return spring 31. When the user releases his/her hold on the accelerator grip 23 or when the user weakens the rotation force of the accelerator grip 23 after the accelerator grip 23 rotates, the accelerator grip 23 returns to the initial position by the restoring force of the return spring 31.

The return spring 31 may be located outside the handle bar 22, or may be located in the handle bar 22. FIG. 4 shows an example of the former case. In this example, the tiller handle 21 includes the inner ring 30 that rotates together with the accelerator grip 23 around the center line CL1 of the handle bar 22 and a handle case 32 that houses the return spring 31 and the inner ring 30. The inner ring 30, the return spring 31, and the handle case 32 are located closer to the outboard motor main body 2 (in FIG. 4, on the right-hand side) with respect to the accelerator grip 23.

The inner ring 30 surrounds the handle bar 22. The inner ring 30 is connected to the sleeve 25 of the accelerator grip 23 by a concave portion 29 that is hollow in the axial direction Da of the handle bar 22 and a convex portion 28 inserted in the concave portion 29. The concave portion 29 is located at one of the inner ring 30 and the sleeve 25, and the convex portion 28 is located at the other one of the inner ring 30 and the sleeve 25. FIG. 4 shows an example in which the concave portion 29 is located at the inner ring 30, and the convex portion 28 is located at the sleeve 25. When the accelerator grip 23 rotates, the inner ring 30 rotates at the same angle and in the same direction as the accelerator grip 23.

The return spring 31 is preferably a coil spring that spirally surrounds the handle bar 22. An end of the return spring 31 is a movable end 31*m* attached to the inner ring 30. The other end of the return spring 31 is a fixed end 31*f* attached to the handle case 32. The handle case 32 is fixed to the handle bar 22. Therefore, the other end of the return spring 31 is fixed to the handle bar 22 through the handle case 32.

When the accelerator grip 23 rotates with respect to the handle bar 22, the movable end 31*m* of the return spring 31 rotates with respect to the handle bar 22 around the center line CL1 of the handle bar 22 at the same angle and in the same direction as both the inner ring 30 and the accelerator grip 23. The fixed end 31*f* of the return spring 31 is fixed to the handle bar 22, and therefore the return spring 31 is elastically deformed when the movable end 31*m* of the return spring 31 rotates with respect to the handle bar 22. Thus, a restoring force that returns the accelerator grip 23 to the initial position is generated.

The electric outboard motor 1 includes an accelerator position sensor 35 that detects the position of the accelerator grip 23. The accelerator position sensor 35 is, for example, an angular sensor that detects the rotation angle of the accelerator grip 23 with respect to the handle bar 22 from the initial position. The accelerator position sensor 35 may be located in the handle case 32, or may be located outside the handle case 32. In the latter case, the accelerator position sensor 35 may be located in the handle bar 22. FIG. 4 shows an example in which the accelerator position sensor 35 is located in the outboard motor main body 2.

In the example shown in FIG. 4, the electric outboard motor 1 includes a link 34 that rotates in response to the rotation of the accelerator grip 23 and two wires 33 that connect the inner ring 30 and the link 34 together. An end of each of the wires 33 is attached to the inner ring 30 in the handle case 32. The other end of each of the wires 33 is attached to the link 34 in the outboard motor main body 2.

When the accelerator grip 23 rotates from the initial position, the rotation of the inner ring 30 is transmitted to the link 34 by one of the two wires 33. Thus, the link 34 rotates at a rotation angle corresponding to the rotation angle of the accelerator grip 23. When the accelerator grip 23 returns to the initial position, the rotation of the inner ring 30 is transmitted to the link 34 by the other one of the two wires 33, and the link 34 returns to the original position.

The accelerator position sensor 35 detects the rotation angle of the accelerator grip 23 with respect to the handle bar 22 from the initial position by detecting the rotation angle of the link 34. A detection value of the accelerator position sensor 35 is transmitted to an ECU 61. The accelerator position sensor 35 is, for example, a potentiometer. The accelerator position sensor 35 may be a sensor other than a potentiometer such as a magnetic sensor.

Next, the shift switch 41 will be described.

The shift switch 41 includes a switch button 42 that moves between an ON position and an OFF position. FIG. 4 shows a state in which the switch button 42 is located in the OFF position. A case in which the switch button 42 is located in the OFF position is described in the following description unless an explanatory note is provided.

FIG. 4 shows an example in which the switch button 42 has a pillar shape that extends in the axial direction Da of the handle bar 22. The switch button 42 protrudes in the axial direction Da of the handle bar 22 from the distal end surface 23*d* of the accelerator grip 23. The switch button 42 is inserted in the accelerator grip 23 and in the handle bar 22. The switch button 42 is surrounded by the handle bar 22, and the handle bar 22 is surrounded by the accelerator grip 23.

The shift switch 41 additionally includes a movable contact 46 that moves together with the switch button 42, a stationary contact 47 that comes into contact with the movable contact 46 when the switch button 42 is in the ON position, and a switch spring 49 that holds the switch button 42 in the OFF position. One end surface (in FIG. 4, end surface on the left-hand side), which is opposite to the outboard motor main body 2, of the two end surfaces of the switch button 42 is a distal end surface 42*d* of the switch button 42, and an end surface (in FIG. 4, end surface on the right-hand side), which is closer to the outboard motor main body 2, of the two end surfaces of the switch button 42 is a proximal end surface 42*p* of the switch button 42. The distal end surface 42*d* of the switch button 42 is located outside the handle bar 22. The proximal end surface 42*p* of the switch button 42 is located in the handle bar 22. Likewise, the movable contact 46, the stationary contact 47, and the switch spring 49 are located in the handle bar 22.

The movable contact 46 is attached to the proximal end surface 42*p* of the switch button 42. The stationary contact 47 is fixed to the handle bar 22. The movable contact 46 and the stationary contact 47 face each other with an interval, i.e., a gap or a distance, between the movable contact 46 and the stationary contact 47 in the axial direction Da of the handle bar 22. Two wirings 48 are attached to the stationary contact 47 in the handle bar 22. The two wirings 48 extend from the stationary contact 47 toward the outboard motor main body 2 in the handle bar 22.

When the switch button 42 is located in the ON position and when the movable contact 46 comes into contact with the stationary contact 47, the two wirings 48 are electrically connected together by the movable contact 46 and the stationary contact 47, and electricity flows between the two wirings 48. Thus, the shift switch 41 is turned from OFF to ON, and an electric signal that transmits it is input into the ECU 61.

The switch spring 49 is, for example, a helical compression spring that spirally surrounds the center line CL1 of the handle bar 22. The movable contact 46 and the stationary contact 47 are surrounded by the switch spring 49. The switch spring 49 is located between an annular spring bearing 50 located on an inner peripheral surface 22*i* of the handle bar 22 and the proximal end surface 42*p* of the switch button 42. The switch spring 49 is compressed by both the spring bearing 50 and the switch button 42 in the axial direction Da of the handle bar 22. When the user separates his/her hand from the switch button 42 or when the user weakens a pushing force against the switch button 42 after the switch button 42 moves to the ON position, the switch button 42 returns to the OFF position by the restoring force of the switch spring 49.

Next, the switch button 42 will be described in detail.

Figure 5A:
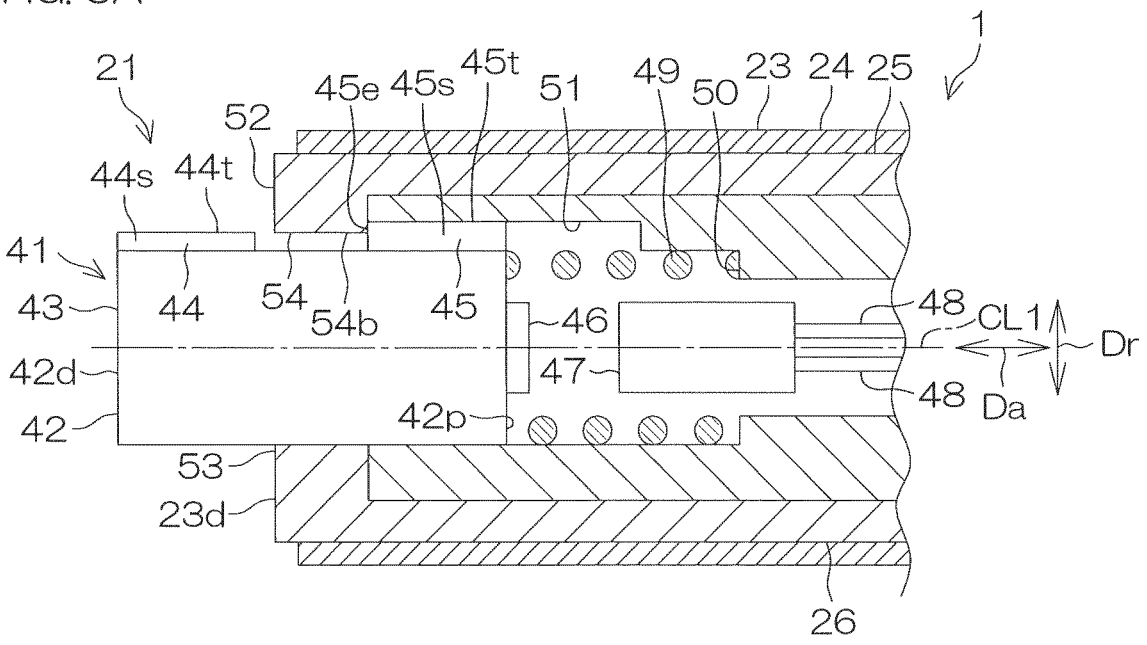
FIG. 5A is an enlarged cross-sectional view of a portion of FIG. 4.
Figure 5B:
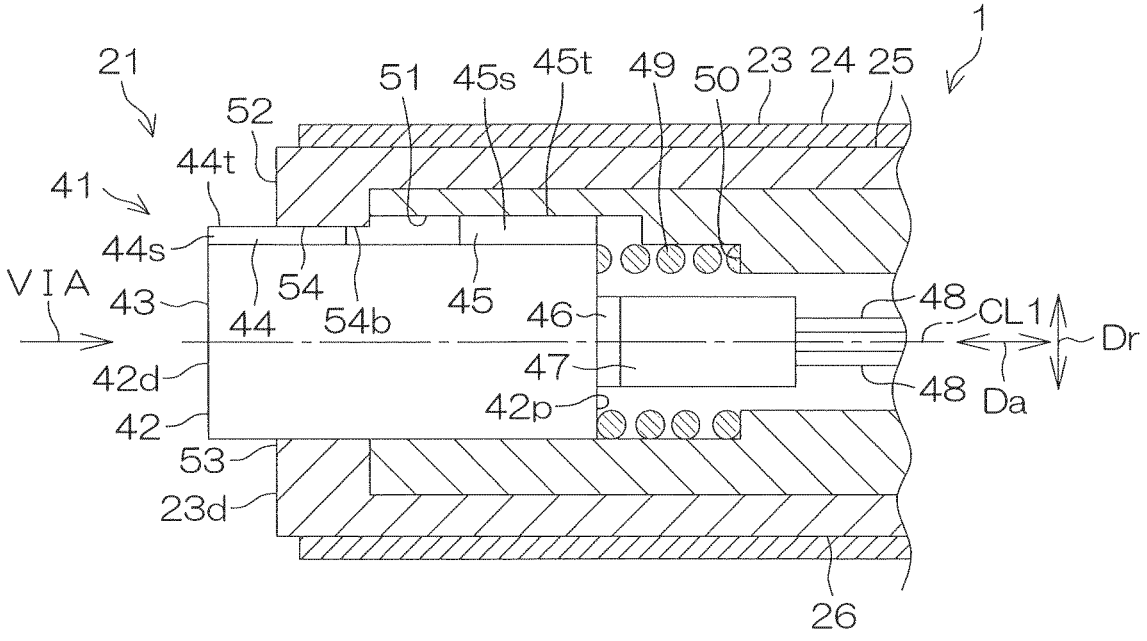
FIG. 5B is a cross-sectional view in which a switch button has been moved to an ON position with respect to FIG. 5A.
Figure 6A:
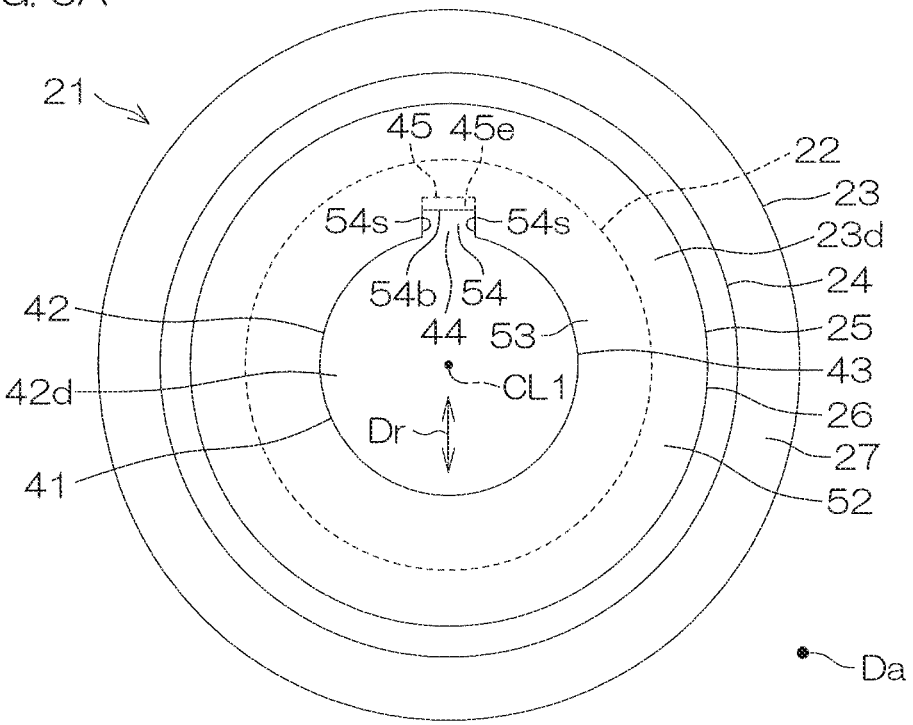
FIG. 6A is an external view of the tiller handle seen in a direction along an arrow VIA shown in FIG. 5B.
Figure 6B:
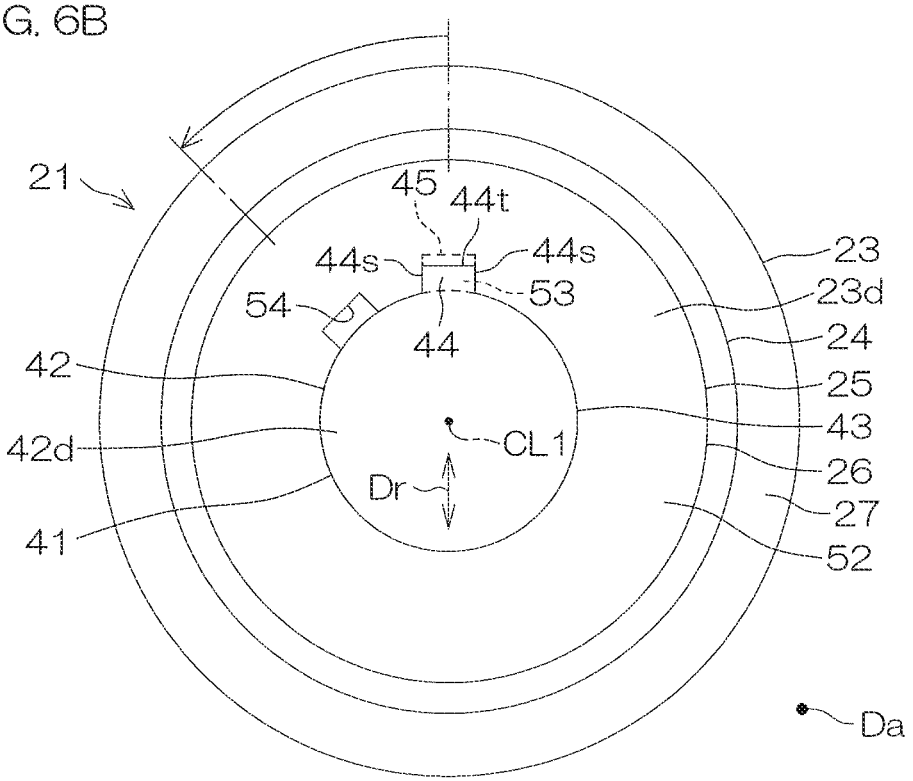
FIG. 6B is a cross-sectional view in which an accelerator grip has been rotated with respect to FIG. 6A.

FIG. 5A is an enlarged cross-sectional view of a portion of FIG. 4, and shows a state in which the switch button 42 is located in the OFF position. FIG. 5B is a cross-sectional view in which the switch button 42 has been moved to the ON position with respect to FIG. 5A. FIG. 6A is an external view of the tiller handle 21 seen in a direction along an arrow VIA shown in FIG. 5B. FIG. 6B is a cross-sectional view in which the accelerator grip 23 has been rotated with respect to FIG. 6A. Hereinafter, a description will be given of a case in which the accelerator grip 23 is located in the initial position and in which the switch button 42 is located in the OFF position unless an explanatory note is provided.

As described above, the switch button 42 is movable between the ON position and the OFF position with respect to the handle bar 22. FIGS. 5A and 5B show an example in which the switch button 42 linearly reciprocates in the axial direction Da of the handle bar 22. The ON position and the OFF position are respectively positions of both ends of a space through which the switch button 42 passes. The OFF position is a position in which the movable contact 46 is farthest from the stationary contact 47.

As shown in FIGS. 5A and 5B, the switch button 42 includes a switch body 43 that moves between the ON position and the OFF position and an inner slider 45 and an outer slider 44 that are located on an outer peripheral surface of the switch body 43. The inner slider 45 is located in the handle bar 22. The outer slider 44 is located outside the handle bar 22. FIGS. 5A and 5B show an example in which the inner slider 45 and the outer slider 44 are projections each of which protrudes from the outer peripheral surface of the switch body 43.

The switch body 43 has a cylindrical shape extending in the axial direction Da of the handle bar 22 (also see FIG. 3). The axial direction of the switch body 43 coincides with the axial direction Da of the handle bar 22. The switch body 43 is coaxial with the handle bar 22, and a center line of the switch body 43 is located on the center line CL1 of the handle bar 22. The switch body 43 is shorter than the accelerator grip 23 in the axial direction Da of the handle bar 22.

The inner slider 45 and the outer slider 44 move together with the switch body 43 in the axial direction Da of the handle bar 22. The inner slider 45 and the outer slider 44 extend in the axial direction Da of the handle bar 22 on the outer peripheral surface of the switch body 43. The inner slider 45 and the outer slider 44 face each other with a distance between the inner slider 45 and the outer slider 44 in the axial direction Da of the handle bar 22 (also see FIG. 3).

FIGS. 5A and 5B show an example in which the inner slider 45 and the outer slider 44 each have a rectangular parallelepiped shape, for example. A cross section of the inner slider 45 along a flat surface perpendicular to the center line CL1 of the handle bar 22 is uniform from an end of the inner slider 45 to the other end of the inner slider 45. The same applies to the outer slider 44. The inner slider 45 may have a shape other than the rectangular parallelepiped shape. Likewise, the outer slider 44 may have a shape other than the rectangular parallelepiped shape.

In the example shown in FIGS. 5A and 5B, the inner slider 45 includes a pair of lateral surfaces 45*s* that extend from the outer peripheral surface of the switch body 43 outwardly in the radial direction Dr of the handle bar 22 and a top surface 45*t* located between the pair of lateral surfaces 45*s*. Likewise, in this example, the outer slider 44 includes a pair of lateral surfaces 44*s* that extend from the outer peripheral surface of the switch body 43 outwardly in the radial direction Dr of the handle bar 22 and a top surface 44*t* located between the pair of lateral surfaces 44*s*. The pair of lateral surfaces 45*s* of the inner slider 45 are a pair of flat surfaces parallel or substantially parallel to each other, and the top surface 45*t* of the inner slider 45 is a flat surface perpendicular or substantially perpendicular to the pair of lateral surfaces 45*s* of the inner slider 45. Likewise, the pair of lateral surfaces 44*s* of the outer slider 44 are a pair of flat surfaces parallel or substantially parallel to each other, and the top surface 44*t* of the outer slider 44 is a flat surface perpendicular or substantially perpendicular to the pair of lateral surfaces 44*s* of the outer slider 44.

As shown in FIGS. 5A and 5B, the handle bar 22 includes a slide guide 51 that guides the inner slider 45 in the axial direction Da of the handle bar 22 that is a moving direction of the switch body 43. If the inner slider 45 is a projection, the slide guide 51 is a groove that is hollowed outwardly in the radial direction Dr of the handle bar 22 from the inner peripheral surface 22*i* of the handle bar 22. The slide guide 51 extends in the axial direction Da of the handle bar 22. The slide guide 51 has a cross section similar to the cross section of the inner slider 45. For example, if the cross section of the inner slider 45 is rectangular, the cross section of the slide guide 51 is also rectangular.

The inner slider 45 is inserted in the slide guide 51. The inner slider 45 is movable in the axial direction Da of the handle bar 22 along the slide guide 51. The switch button 42 is prevented from moving in a circumferential direction of the handle bar 22 because of contact between the inner slider 45 and the slide guide 51. Therefore, the inner slider 45 and the slide guide 51 guide the switch button 42 in the axial direction Da of the handle bar 22 while preventing the rotation of the switch button 42 with respect to the handle bar 22.

The sleeve 25 includes a ring stopper 52, in addition to the tube 26 and the flange 27. An inner peripheral surface of the ring stopper 52 defines a hole that passes through the ring stopper 52 in the axial direction Da of the handle bar 22. The switch button 42 is inserted in the ring stopper 52. As shown in FIG. 6A, the inner peripheral surface of the ring stopper 52 is similar to an outer peripheral surface of the switch button 42 when seen in the axial direction Da of the handle bar 22. The ring stopper 52 includes an annular shift stopper 53 located around the switch body 43 and an accelerator stopper 54 that faces the outer slider 44 in the axial direction Da of the handle bar 22.

If the outer slider 44 is a projection as shown in FIG. 6A, the accelerator stopper 54 is a cutout that is hollowed from the inner peripheral surface of the shift stopper 53 outwardly in the radial direction Dr of the handle bar 22. The outer slider 44 refers to a portion that enters the accelerator stopper 54 in a state in which the accelerator grip 23 is located in the initial position and that overlaps the shift stopper 53 when seen in the axial direction Da of the handle bar 22 in a state in which the accelerator grip 23 is located in a position other than the initial position (see FIGS. 6A and 6B).

An inner surface of the accelerator stopper 54 is similar to an outer surface of the outer slider 44 when seen in the axial direction Da of the handle bar 22. In an example shown in FIG. 6A, the accelerator stopper 54 includes a pair of lateral surfaces 54*s* that extend from the inner peripheral surface of the shift stopper 53 outwardly in the radial direction Dr of the handle bar 22 and a bottom surface 54*b* located between the pair of lateral surfaces 54*s*. As shown in FIG. 5B, the slide guide 51 and the accelerator stopper 54 are arranged side by side in the axial direction Da of the handle bar 22. A space in the accelerator stopper 54 and a space in the slide guide 51 are continuous with each other in the axial direction Da of the handle bar 22.

As shown in FIG. 5A, when the accelerator grip 23 is located in the initial position and when the switch button 42 is located in the OFF position, the outer slider 44 and the accelerator stopper 54 face each other in the axial direction Da of the handle bar 22. At this time, any portion of the outer slider 44 is not located inside the accelerator stopper 54. When the switch button 42 is moved toward the ON position in a state in which the accelerator grip 23 is located in the initial position, the outer slider 44 is inserted into the accelerator stopper 54 as shown in FIG. 5B.

The outer slider 44 is able to enter the accelerator stopper 54, whereas the inner slider 45 is not able to enter the accelerator stopper 54. In other words, the inner slider 45 has a shape that makes it impossible to pass through the accelerator stopper 54. FIG. 5B shows an example in which the height of the inner slider 45 in the radial direction Dr of the handle bar 22 is set at a value that makes it impossible to pass through the accelerator stopper 54. In this example, the top surface 45*t* of the inner slider 45 is located at a more outward position in the radial direction Dr of the handle bar 22 than the bottom surface 54*b* of the accelerator stopper 54.

The length of the inner slider 45 in the circumferential direction of the handle bar 22 may be longer than the length of the accelerator stopper 54 in the circumferential direction of the handle bar 22 instead of setting the height of the inner slider 45 as above or in addition to setting the same as above. FIG. 6A shows an example in which the inner slider 45 is longer than the outer slider 44 in the radial direction Dr of the handle bar 22, and the width of the inner slider 45 (distance between the two lateral surfaces 45*s*) is equal to the width of the outer slider 44 (distance between the two lateral surfaces 44*s*).

The inner slider 45 is not able to pass through the accelerator stopper 54, and therefore an end surface 45*e* of the inner slider 45 is pressed against the ring stopper 52 by the switch spring 49 as shown in FIG. 5A. The OFF position is a position in which the end surface 45*e* of the inner slider 45 comes into contact with the ring stopper 52. Thus, the switch button 42 is held in the OFF position.

As described above, the inner slider 45 and the outer slider 44 face each other with a distance between the inner slider 45 and the outer slider 44 in the axial direction Da of the handle bar 22 that coincides with an axial direction of the switch button 42. The thickness of the shift stopper 53, i.e., the length of the ring stopper 52 in the axial direction Da of the handle bar 22 is smaller than the distance between the inner slider 45 and the outer slider 44 in the axial direction Da of the handle bar 22. Therefore, the shift stopper 53 is able to enter a space between the inner slider 45 and the outer slider 44.

When the accelerator grip 23 is located in the initial position as shown in FIG. 6A, the shift stopper 53 is not located between the inner slider 45 and the outer slider 44. When the accelerator grip 23 is rotated from the initial position in a state in which the switch button 42 is located in the OFF position, the shift stopper 53 enters the space between the inner slider 45 and the outer slider 44 as shown in FIG. 6B. Therefore, when the switch button 42 is located in the OFF position, the accelerator grip 23 rotates with respect to the handle bar 22 without being hindered by the outer slider 44.

On the other hand, when the accelerator grip 23 is located in a position other than the initial position, a portion of the shift stopper 53 is located between the inner slider 45 and the outer slider 44. As shown in FIG. 6B, the outer slider 44 faces the shift stopper 53 in the axial direction Da of the handle bar 22. When the switch button 42 is moved from the OFF position toward the ON position in this state, the outer slider 44 comes into contact with the shift stopper 53, and stops before arriving at the ON position. Therefore, when the accelerator grip 23 is located in a position other than the initial position, the switch button 42 cannot be moved to the ON position.

When the accelerator grip 23 is returned to the initial position as shown in FIG. 6A, the outer slider 44 and the accelerator stopper 54 again face each other in the axial direction Da of the handle bar 22. When the switch button 42 is moved from the OFF position toward the ON position in a state in which the accelerator grip 23 is located in the initial position, the outer slider 44 is inserted into the accelerator stopper 54 as shown in FIG. 5B. Therefore, when the accelerator grip 23 is located in the initial position, the switch button 42 is moved to the ON position without being hindered by the shift stopper 53.

Likewise, when the switch button 42 is located in the ON position as shown in FIG. 5B, at least one portion of the outer slider 44 is located inside the accelerator stopper 54. When a force by which the accelerator grip 23 is rotated is applied onto the accelerator grip 23 in a state in which the outer slider 44 is inserted in the accelerator stopper 54, the accelerator stopper 54 comes into contact with the outer slider 44, and the rotation of the accelerator grip 23 stops. Therefore, when the switch button 42 is located in a position other than the OFF position, the accelerator grip 23 cannot be rotated with respect to the handle bar 22.

Figure 7:
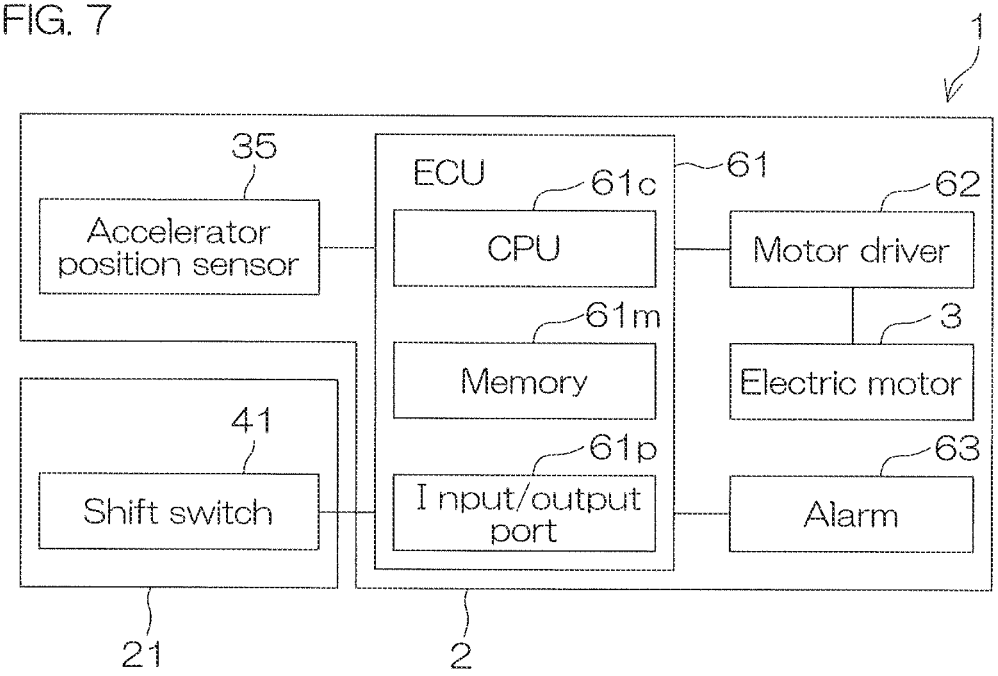
FIG. 7 is a block diagram showing an electric configuration of the electric outboard motor.

FIG. 7 is a block diagram showing an electric configuration of the electric outboard motor 1.

The ECU 61 (Electronic Control Unit) is, for example, a microcomputer that includes a CPU (central processing unit) 61*c* that performs controls and calculations, a memory 61*m* that stores information necessary for the controls and calculations performed by the CPU 61*c*, and an input/output port 61*p* that sends and receives information. The ECU 61 is connected to the electric motor 3 through a motor driver 62 that is an electric circuit that drives the electric motor 3. The ECU 61 is additionally connected to the accelerator position sensor 35 and to the shift switch 41.

The electric outboard motor 1 may additionally include an alarm 63 that communicates the information that the outboard motor main body 2 is in the reverse mode. The alarm 63 may be, for example, any one among a buzzer that emits sounds, a lamp that emits rays of light, a display that displays words and drawings, and a vibrator that emits vibrations, or may be two or more among these alarms. The alarm 63 may be attached to the tiller handle 21 or to the outboard motor main body 2, or may be located in the hull H1. FIG. 7 shows an example in which the alarm 63 is located in the outboard motor main body 2.

Based on a detection value of the accelerator position sensor 35, the ECU 61 determines whether a mode switching condition is established. The fact that the accelerator grip 23 is located in the initial position is included in the mode switching condition. When the shift switch 41 is closed in a state in which the accelerator grip 23 is located in the initial position, the ECU 61 switches the outboard motor main body 2 to either one of the forward mode and the reverse mode. The ECU 61 is programmed to perform the following control.

Figure 8:
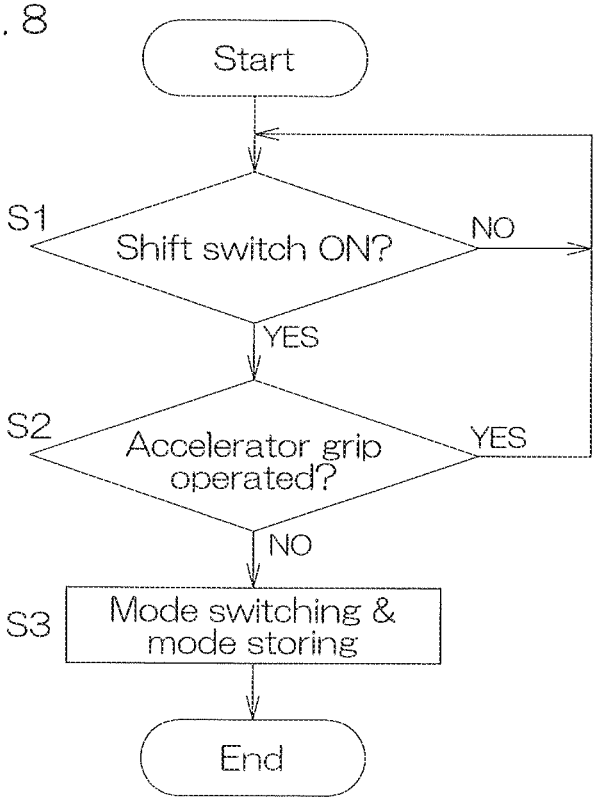
FIG. 8 is a flowchart showing a process flow when the shift switch is operated.

FIG. 8 is a flowchart showing a flow when the shift switch 41 is operated. Reference is hereinafter made to FIG. 4, FIG. 7, and FIG. 8.

When the switch button 42 is located in the ON position and when the shift switch 41 is closed, an electric signal that transmits this information is input into the ECU 61. Based on the signal input from the shift switch 41, the ECU 61 monitors whether the shift switch 41 has been closed, i.e., whether the switch button 42 has been placed in the ON position (step S1).

If the shift switch 41 has been closed (Yes in step S1), the ECU 61 determines, based on a detection value of the accelerator position sensor 35, whether the accelerator grip 23 has been operated, i.e., whether the accelerator grip 23 has been placed in a position other than the initial position (step S2). If the accelerator grip 23 is not in the initial position (Yes in step S2), the ECU 61 does not change the state of the outboard motor main body 2 even if the shift switch 41 has been closed. In this case, the ECU 61 may enable the alarm 63 to communicate the information that the accelerator grip 23 is located in a position other than the initial position and the mode switching condition is not established.

As described above, in the arrangement of FIG. 4, the switch button 42 is able to move to the ON position only when the accelerator grip 23 is located in the initial position. Therefore, the fact that the switch button 42 is located in the ON position denotes that the accelerator grip 23 is located in the initial position (Yes in step S1, and No in step S2). In other words, in the arrangement of FIG. 4, the fact that the switch button 42 is located in the ON position denotes that the mode switching condition is established.

If the accelerator grip 23 is in the initial position and if the mode switching condition is established (No in step S2), the ECU 61 switches the state of the outboard motor main body 2 from one of the forward mode and the reverse mode to the other one of these modes, and the state of the outboard motor main body 2 whose mode has been changed is stored in the memory 61*m* (step S3). Therefore, even if the shift stopper 53 is not provided (see FIG. 4), the switching of the state of the outboard motor main body 2 is allowed only when the accelerator grip 23 is located in the initial position.

Figure 9:
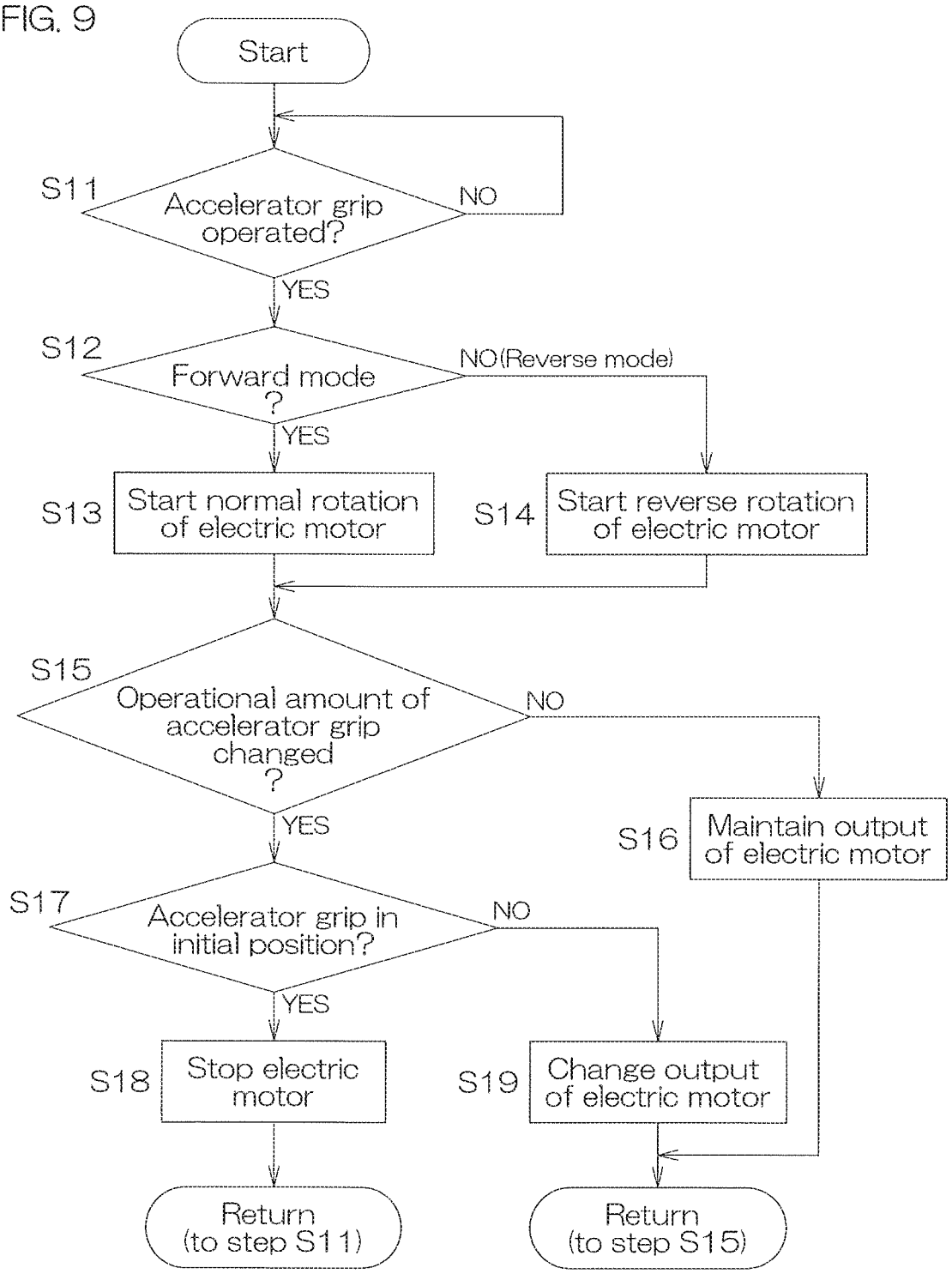
FIG. 9 is a flowchart showing a process flow when the accelerator grip is operated.

FIG. 9 is a flowchart showing a flow when the accelerator grip 23 is operated. Reference is hereinafter made to FIG. 4, FIG. 7, and FIG. 9.

Based on a detection value of the accelerator position sensor 35, the ECU 61 determines whether the accelerator grip 23 has been operated, i.e., whether the accelerator grip 23 has been moved to a position other than the initial position (step S11). If the accelerator grip 23 has been operated (Yes in step S11), the ECU 61 ascertains the latest state of the outboard motor main body 2 stored in the memory 61*m* (step S12).

FIG. 9 shows an example in which it is ascertained whether the latest state of the outboard motor main body 2 is the forward mode in step S12. If the state of the outboard motor main body 2 is the forward mode (Yes in step S12), the ECU 61 rotates the electric motor 3 in the forward rotation direction (step S13). If the state of the outboard motor main body 2 is the reverse mode (No in step S12), the ECU 61 rotates the electric motor 3 in the reverse rotation direction opposite to the forward rotation direction (step S14).

The ECU 61 causes the electric motor 3 to start rotating, and thereafter, based on a detection value of the accelerator position sensor 35, the ECU 61 determines whether the operational amount of the accelerator grip 23 has changed, i.e., whether the rotation angle of the accelerator grip 23 has changed (step S15). If the operational amount of the accelerator grip 23 has not changed (No in step S15), the ECU 61 maintains the output of the electric motor 3 (step S16), and again determines whether the operational amount of the accelerator grip 23 has changed (step S15).

If the operational amount of the accelerator grip 23 has changed after the rotation of the electric motor 3 is started (Yes in step S15), the ECU 61 determines whether the accelerator grip 23 has returned to the initial position (step S17). If the accelerator grip 23 has returned to the initial position (Yes in step S17), the ECU 61 causes the electric motor 3 to stop rotating (step S18). Thereafter, the ECU 61 again determines whether the accelerator grip 23 has been operated (step S11).

If the operational amount of the accelerator grip 23 has changed (Yes in step S15) and if the accelerator grip 23 has not returned to the initial position (No in step S17), the ECU 61 changes the output of the electric motor 3 in accordance with the operational amount of the accelerator grip 23 from the initial position by changing the magnitude of an electric current supplied to the electric motor 3 (step S19). Thereafter, the ECU 61 again determines whether the operational amount of the accelerator grip 23 has changed (step S15).

In the preferred embodiments of the present invention described above, the accelerator grip 23 and the shift switch 41 are located on the tiller handle 21. When the user operates the shift switch 41, the outboard motor main body 2 is switched to the forward mode or to the reverse mode. If the user rotates the accelerator grip 23 when the outboard motor main body 2 is in the forward mode, the electric motor 3 rotates in the forward rotation direction, and the propeller 13 generates a thrust by which the vessel is forwardly moved. If the user rotates the accelerator grip 23 when the outboard motor main body 2 is in the reverse mode, the electric motor 3 rotates in the reverse rotation direction, and the propeller 13 generates a thrust by which the vessel is backwardly moved. Therefore, the user is able to perform switching between a forward movement and a backward movement of the vessel even if the user does not change the rotation direction of the accelerator grip 23.

The shift switch 41 is located closer to the distal end of the accelerator grip 23 with respect to the proximal end of the accelerator grip 23. In other words, the shift switch 41 is located on the accelerator grip 23 or is located near the accelerator grip 23, and the distance from the user's hand with which the accelerator grip 23 is grasped to the shift switch 41 is short. Therefore, the user is able to operate the shift switch 41 with the user's hand with which the accelerator grip 23 is grasped. Alternatively, the user is able to operate the shift switch 41 with the remaining user's hand other than the hand with which the accelerator grip 23 is grasped without largely twisting the user's body. Therefore, the user is able to easily operate the shift switch 41.

In the preferred embodiments of the present invention described above, the state of the outboard motor main body 2 is able to be switched in response to the operation of the shift switch 41 when the accelerator grip 23 is located in the initial position. The initial position is a position in which the rotor of the electric motor 3 stands still without rotating. Therefore, the state of the outboard motor main body 2 is prevented from being switched even if the user unintentionally touches the shift switch 41 when the electric motor 3 rotates or even if the shift switch 41 hits against something other than the user when the electric motor 3 rotates.

In the preferred embodiments of the present invention described above, the rotation angle of the accelerator grip 23 with respect to the handle bar 22 is detected by the accelerator position sensor 35. Based on a detection value of the accelerator position sensor 35, the ECU 61 determines whether the accelerator grip 23 is located in the initial position, and, when the accelerator grip 23 is located in the initial position, the state of the outboard motor main body 2 is able to be switched in response to the operation of the shift switch 41. Therefore, it is possible to prevent the switching of the state of the outboard motor main body 2 even if a mechanical restriction, such as the shift stopper 53, is not used.

In the preferred embodiments of the present invention described above, the switch button 42 of the shift switch 41 is moved by the user between the ON position and the OFF position. The shift state of the outboard motor main body 2 is maintained when the switch button 42 is in the OFF position. When the user moves the switch button 42 to the ON position, the state of the outboard motor main body 2 is switched to the forward mode or to the reverse mode.

If the user attempts to move the switch button 42 to the ON position in a state in which the accelerator grip 23 is located in the initial position, the switch button 42 moves to the ON position without hitting against the shift stopper 53. If the user attempts to move the switch button 42 to the ON position in a state in which the accelerator grip 23 is located in a position other than the initial position, the switch button 42 hits against the shift stopper 53, and stops before arriving at the ON position. Therefore, even if an electric restriction is not used, it is possible to allow the state of the outboard motor main body 2 to be switched in response to the operation of the shift switch 41 when the accelerator grip 23 is located in the initial position.

In the preferred embodiments of the present invention described above, it is impossible to rotate the accelerator grip 23 with respect to the handle bar 22 when the switch button 42 is in the ON position. Therefore, the rotation of the accelerator grip 23 is prevented by the accelerator stopper 54 even if a force by which the accelerator grip 23 is rotated is unintentionally applied onto the accelerator grip 23 when the user moves the switch button 42 to the ON position. This makes it possible to prevent the electric motor 3 from starting rotating during the operation of the switch button 42.

In the preferred embodiments of the present invention described above, if the user attempts to rotate the accelerator grip 23 in a state in which the switch button 42 is in the ON position, the accelerator grip 23 hits against the accelerator stopper 54, and the rotation is prevented. On the other hand, if the user attempts to rotate the accelerator grip 23 in a state in which the switch button 42 is in the OFF position, the accelerator grip 23 rotates with respect to the handle bar 22 without hitting against the accelerator stopper 54. Therefore, it is possible to rotate the electric motor 3 when the shift state of the outboard motor main body 2 is maintained.

In the preferred embodiments of the present invention described above, the accelerator grip 23 rotates not only with respect to the handle bar 22 but also with respect to the shift switch 41. Even if the user rotates the accelerator grip 23 with respect to the handle bar 22, the shift switch 41 does not rotate with respect to the handle bar 22. If the shift switch 41 rotates with respect to the handle bar 22, electrical components, such as a collector ring and a rotary connector, that transmit electricity between a rotational component and a non-rotational component are required. If the shift switch 41 does not rotate with respect to the handle bar 22, such electrical components are not required. Therefore, it is possible to simplify the structure of the electric outboard motor 1.

In the preferred embodiments of the present invention described above, when the outboard motor main body 2 is switched to the reverse mode, this information is communicated by one or more among sounds, rays of light, words, drawings, and vibrations, for example. Therefore, based on a notice issued by the alarm 63, such as sounds, the user of the electric outboard motor 1 is able to reliably understand that the outboard motor main body 2 is in the reverse mode.

In the preferred embodiments of the present invention described above, the transmission path 8 that extends from the electric motor 3 to the propeller 13 is provided. When the electric motor 3 rotates in the reverse rotation direction, the rotation of the electric motor 3 is transmitted to the propeller 13 through the same path (transmission path 8) as when the electric motor 3 rotates in the forward rotation direction. In an outboard motor including an engine, a dog clutch is moved and a path to transmit the rotation is switched in order to reversely rotate the propeller 13. Therefore, if the mode of the outboard motor main body 2 is switched by operating the shift switch 41, it is possible to reversely rotate the propeller 13 without switching the transmission path 8 that transmits the rotation of the electric motor 3.

Other Preferred Embodiments

Preferred embodiments of the present invention are not limited to the contents of the preferred embodiments described above, and various modifications are possible.

For example, the inner slider 45 of the switch button 42 may be a groove hollowed from the outer peripheral surface of the switch body 43 without being limited to a projection. In this case, the slide guide 51 of the handle bar 22 may be a projection inserted in the inner slider 45.

The inner slider 45 and the outer slider 44 of the switch button 42 are not necessarily required to face each other with a distance between the inner slider 45 and the outer slider 44 in the axial direction Da of the handle bar 22. In other words, the inner slider 45 and the outer slider 44 may be located at mutually different positions with respect to the circumferential direction of the handle bar 22.

Both the inner slider 45 and the outer slider 44 may be grooves. One of the inner slider 45 and the outer slider 44 may be a groove, and the other one of the inner slider 45 and the outer slider 44 may be a projection.

The outer slider 44 of the switch button 42 may be omitted. In other words, an outer peripheral surface of a portion, which protrudes from the distal end surface 23*d* of the accelerator grip 23, of the switch button 42 may have a cylindrical shape. In this case, the accelerator stopper 54 of the accelerator grip 23 may be omitted. In other words, the inner peripheral surface of the shift stopper 53 may be changed to have a cylindrical shape.

If the outer slider 44 of the switch button 42 is omitted, the ECU 61 may switch the state of the outboard motor main body 2 in accordance with the operation of the shift switch 41 not only when the accelerator grip 23 is located in the initial position but also when the accelerator grip 23 is located in a position other than the initial position.

The switch button 42 may rotate together with the accelerator grip 23 around the center line CL1 of the handle bar 22 with respect to the handle bar 22. In this case, an electrical component that transmits electricity between a rotational component and a non-rotational component may be used. If such an electrical component is used, the switch button 42 may be located on the accelerator grip 23.

Figure 10:
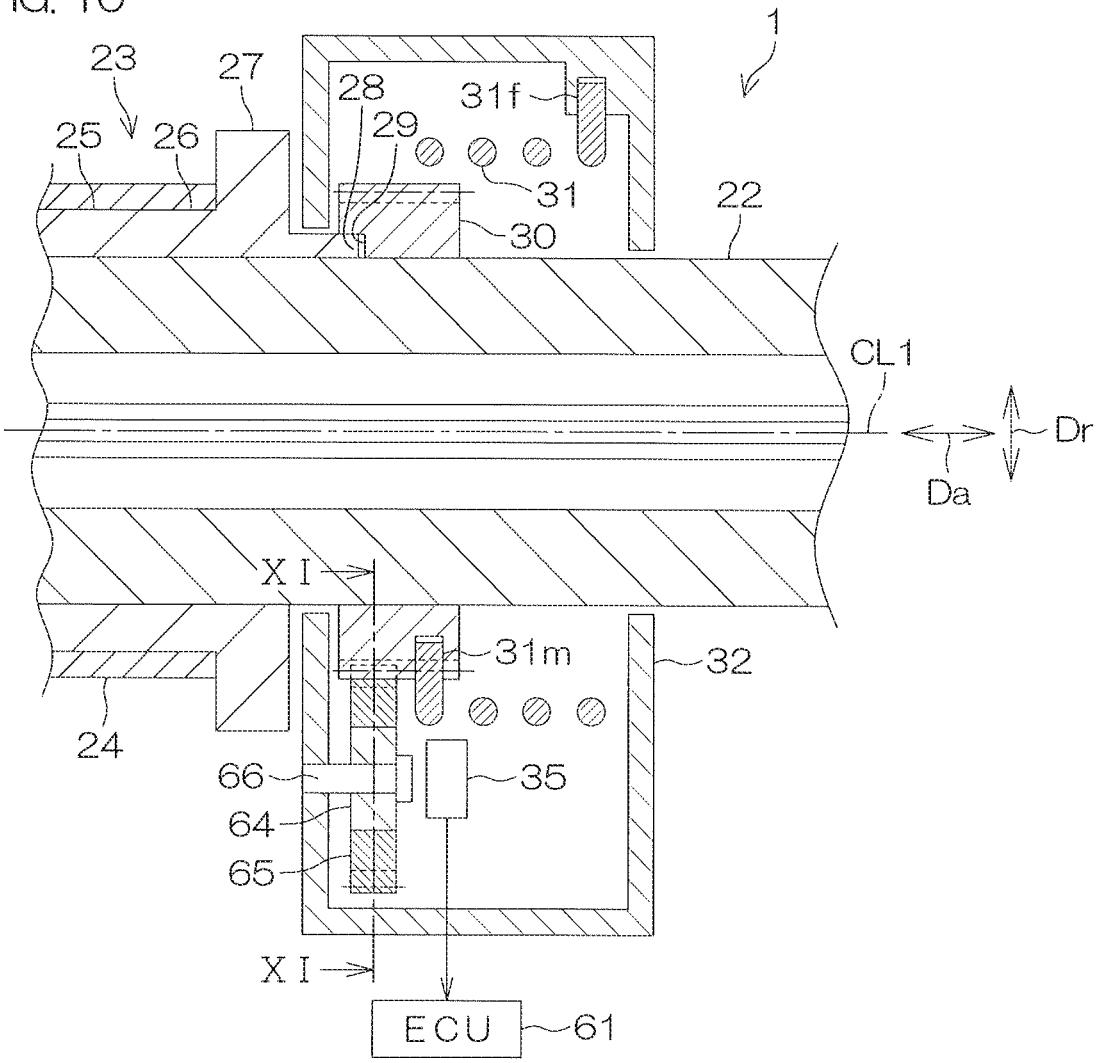
FIG. 10 is a cross-sectional view showing a cross section of a tiller handle according to another preferred embodiment of the present invention.

As shown in FIG. 10, the accelerator position sensor 35 may be located not in the outboard motor main body 2 but in the handle case 32.

As shown in FIG. 10, the tiller handle 21 includes a magnet 64 that faces the accelerator position sensor 35 in the handle case 32, a magnet holder 65 that holds the magnet 64, and a support shaft 66 that supports both the magnet 64 and the magnet holder 65. The magnet 64 and the magnet holder 65 are supported by the handle case 32 through the support shaft 66. The magnet 64 and the magnet holder 65 are rotatable with respect to the handle case 32 around a center line of the support shaft 66.

Figure 11:
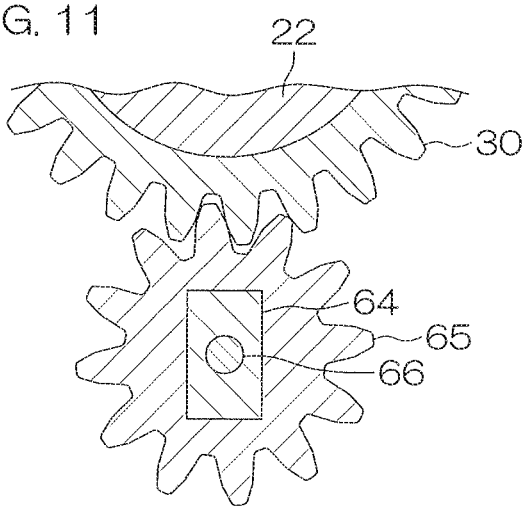
FIG. 11 is a cross-sectional view of a magnet and a magnet holder along line XI-XI shown in FIG. 10.

As shown in FIG. 11, the magnet holder 65 and the inner ring 30 each define an external gear whose teeth are located at its outer periphery. The teeth of the magnet holder 65 engage the teeth of the inner ring 30. The rotation angle of the magnet holder 65 may be equal to the rotation angle of the accelerator grip 23, or may be larger or smaller than the rotation angle of the accelerator grip 23. A relationship between the rotation angle of the accelerator grip 23 and the rotation angle of the magnet holder 65 is stored in the ECU 61.

The accelerator position sensor 35 shown in FIG. 10 may be a Hall element that is an example of a magnetic sensor. When the accelerator grip 23 rotates, the magnet 64 and the magnet holder 65 also rotate, and an output voltage of the accelerator position sensor 35 changes. Therefore, based on the output voltage of the accelerator position sensor 35, the ECU 61 is able to detect the rotation angle of the accelerator grip 23 from the initial position.

Figure 12:
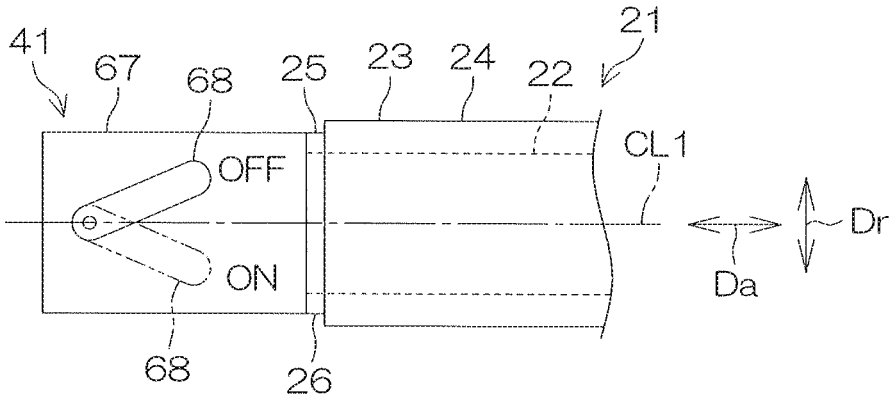
FIG. 12 is a schematic view showing a shift switch according to still another preferred embodiment of the present invention.
Figure 13:
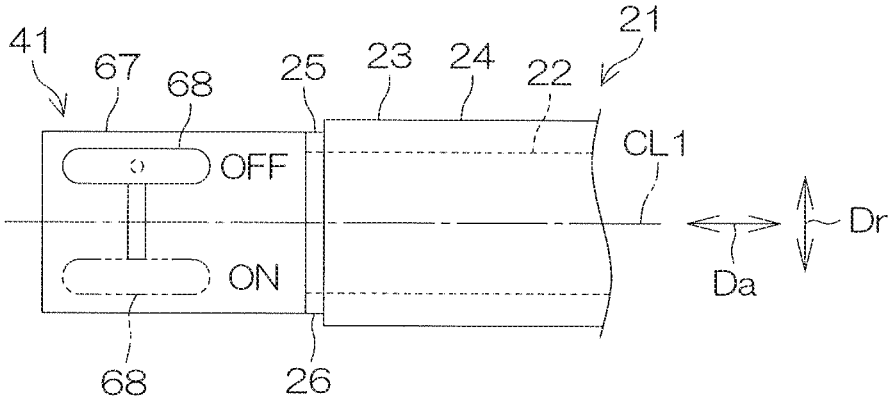
FIG. 13 is a schematic view showing a shift switch according to still another preferred embodiment of the present invention.

The shift switch 41 may include a switch lever 68 or a switch knob 69 instead of the switch button 42. FIG. 12 and FIG. 13 show the switch lever 68, and FIG. 14 shows the switch knob 69.

The tiller handle 21 shown in FIG. 12 and FIG. 13 includes a switch lever 68 and a lever holder 67 instead of the switch button 42. The lever holder 67 may be a rectangular shaped cylinder that extends in the axial direction Da of the handle bar 22. The lever holder 67 is fixed to a distal end of the handle bar 22. The accelerator grip 23 rotates with respect to the handle bar 22, but the lever holder 67 does not rotate. The switch lever 68 is located on an outer peripheral surface of the lever holder 67. The switch lever 68 is attached to the lever holder 67, and is movable between the ON position and the OFF position with respect to the lever holder 67.

The switch lever 68 shown in FIG. 12 is a turn lever that turns between the ON position and the OFF position. The switch lever 68 shown in FIG. 13 is a slide lever that moves in parallel between the ON position and the OFF position. The ON position is a position in which an end of the switch lever 68 comes closest to the letters "ON" written on the outer peripheral surface of the lever holder 67. The OFF position is a position in which the end of the switch lever 68 comes closest to the letters "OFF" written on the outer peripheral surface of the lever holder 67. The switch lever 68 is held in the OFF position by the switch spring 49 (see FIG. 4).

Figure 14:
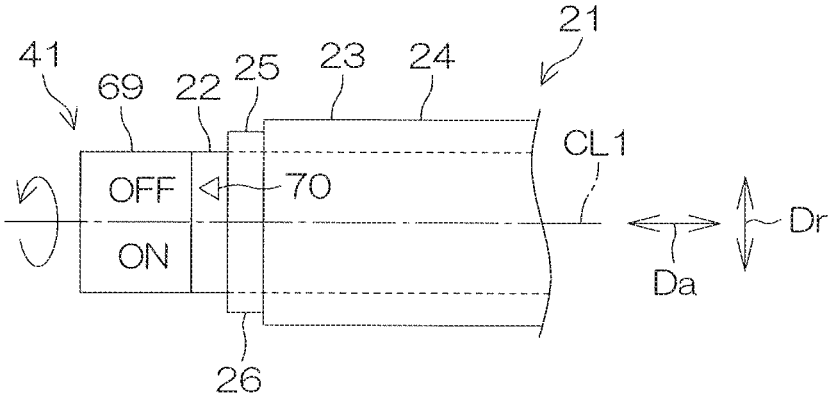
FIG. 14 is a schematic view showing a shift switch according to still another preferred embodiment of the present invention.

The tiller handle 21 shown in FIG. 14 includes the switch knob 69 instead of the switch button 42. The switch knob 69 is a circular cylinder that extends in the axial direction Da of the handle bar 22. The switch knob 69 is attached to the distal end of the handle bar 22. The switch knob 69 is coaxial with the handle bar 22. The switch knob 69 is rotatable around the center line CL1 of the handle bar 22 with respect to the handle bar 22. The accelerator grip 23 rotates with respect to the handle bar 22, but the switch knob 69 does not rotate.

The switch knob 69 is rotatable between the ON position and the OFF position with respect to the handle bar 22. The ON position is a position in which the letters "ON" written on an outer peripheral surface of the switch knob 69 comes closest to a mark 70 written on an outer peripheral surface of the handle bar 22. The OFF position is a position in which the letters "OFF" written on the outer peripheral surface of the switch knob 69 comes closest to the mark 70 written on the outer peripheral surface of the handle bar 22. The switch knob 69 is held in the OFF position by the switch spring 49 (see FIG. 4).

Features of two or more of the various preferred embodiments described above may be combined.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. An electric outboard motor comprising:

an outboard motor main body including an electric motor to rotate a propeller; and a tiller handle to turn together with the outboard motor main body with respect to a hull; wherein the tiller handle includes:

a handle bar to turn together with the outboard motor main body with respect to the hull;

an accelerator grip including a proximal end located closest to the outboard motor main body and a distal end located at a position opposite to the outboard motor main body with respect to the proximal end, the accelerator grip being rotatable with respect to the handle bar, the accelerator grip being rotated when the electric motor is rotated in a forward rotation direction or in a reverse rotation direction; and a shift switch located closer to the distal end of the accelerator grip with respect to the proximal end of the accelerator grip, the shift switch being operated to switch a shift state of the outboard motor main body between a forward mode in which the electric motor rotates in the forward rotation direction in response to rotation of the accelerator grip and a reverse mode in which the electric motor rotates in the reverse rotation direction in response to rotation of the accelerator grip.

2. The electric outboard motor according to claim 1, further comprising a shift limiter to enable the shift state of the outboard motor main body to be switched in response to an operation of the shift switch when the accelerator grip is located in an initial position in which the electric motor does not rotate.

3. The electric outboard motor according to claim 2, further comprising:

an accelerator position sensor to detect a rotation angle of the accelerator grip with respect to the handle bar; wherein the shift limiter includes an electronic controller configured or programmed to determine whether the accelerator grip is located in the initial position based on a detection value of the accelerator position sensor and to enable the shift state of the outboard motor main body to be switched in response to an operation of the shift switch when the accelerator grip is located in the initial position.

4. The electric outboard motor according to claim 2, wherein the shift switch includes a switch button movable between an ON position in which the shift state of the outboard motor main body is switched to the forward mode or to the reverse mode and an OFF position in which the shift state of the outboard motor main body is maintained; and the shift limiter includes a shift stopper to enable the switch button to move to the ON position when the accelerator grip is located in the initial position.

5. The electric outboard motor according to claim 4, further comprising an accelerator stopper to prevent rotation of the accelerator grip with respect to the handle bar when the switch button is in the ON position.

6. The electric outboard motor according to claim 1, wherein the shift switch includes a switch button movable between an ON position in which the shift state of the outboard motor main body is switched to the forward mode or to the reverse mode and an OFF position in which the shift state of the outboard motor main body is maintained; and the electric outboard motor further comprises an accelerator stopper to prevent rotation of the accelerator grip with respect to the handle bar when the switch button is in the ON position.

7. The electric outboard motor according to claim 6, wherein the accelerator stopper enables the accelerator grip to rotate with respect to the handle bar when the switch button is located in the OFF position.

8. The electric outboard motor according to claim 1, wherein the accelerator grip is rotatable with respect to the shift switch; and the shift switch does not rotate with respect to the handle bar even if the accelerator grip rotates with respect to the handle bar.

9. The electric outboard motor according to claim 1, further comprising an alarm to communicate information about the outboard motor main body being in the reverse mode by use of one or more of sounds, rays of light, words, drawings, and vibrations.

10. The electric outboard motor according to claim 1, further comprising a transmission path to transmit rotation of the electric motor from the electric motor to the propeller when the electric motor rotates either in the forward rotation direction or in the reverse rotation direction.

* * * * *